US005396202A

United States Patent [19]

Scheck

[11] Patent Number: 5,396,202

[45] Date of Patent: Mar. 7, 1995

[54] ASSEMBLY AND METHOD FOR COUPLING A MICROSTRIP CIRCUIT TO A CAVITY RESONATOR

[75] Inventor: Hans-Otto Scheck, Fellbach, Germany

[73] Assignee: Valtion Teknillinen Tutkimuskeskus, Espoo, Finland

[21] Appl. No.: 84,225

[22] PCT Filed: Jan. 17, 1992

[86] PCT No.: PCT/FI92/00013

§ 371 Date: Sep. 8, 1993

§ 102(e) Date: Sep. 8, 1993

[87] PCT Pub. No.: WO92/13371

PCT Pub. Date: Jun. 8, 1992

[30] Foreign Application Priority Data

Jan. 17, 1991 [FI] Finland ..... 910247

[51] Int. Cl.[6] ..... H01P 7/06

[52] U.S. Cl. ..... 333/230; 333/26; 343/700 MS

[58] Field of Search ..... 333/227-230, 333/246, 21 R, 26; 331/96, 117 D, 107 DP; 343/700 MS

[56] References Cited

U.S. PATENT DOCUMENTS

| | | | |
|---|---|---|---|
| 4,211,987 | 7/1980 | Pan | 333/230 |
| 4,903,033 | 2/1990 | Tsao et al. | 343/700 MS |
| 4,937,585 | 6/1990 | Shoemaker | 343/700 MS |

*Primary Examiner*—Seungsook Ham

[57] ABSTRACT

An assembly and a method is provided for coupling a microstrip circuit to a cavity resonator. The assembly includes a substrate, a microstrip circuit fabricated on one side of the substrate plate, a ground plane fabricated on the other side of the substrate plate and a cavity resonator. The microstrip is coupled to the cavity resonator by a slot fabricated in the ground plane and a planar radiator disposed between the ground plane and the cavity resonator. The assembly produces a resonator that can operate for frequencies in the range of 1-100 GHz in a simplified and less expensive manufacturing process.

6 Claims, 4 Drawing Sheets

Offset of planar radiator:

x = 5 mm y = 0 mm

Offset of planar radiator:

x = 0 mm y = 1.2 mm

ASSEMBLY AND METHOD FOR COUPLING A MICROSTRIP CIRCUIT TO A CAVITY RESONATOR

BACKGROUND OF THE INVENTION

The present invention relates to an assembly for coupling a microstrip circuit to a cavity resonator.

The invention is also directed to a method for coupling a microstrip circuit to a cavity resonator.

A cavity resonator has a structure which can be mathematically modelled as an LC resonant circuit. The dimensions of the cavity determine its resonant frequencies, several of which are possible depending on the principal dimensions of the cavity. The cavity resonator is excited by a transistor and a microstrip circuit connected to the transistor device.

According to conventional technology, microstrip circuits are used in conjunction with dielectric resonators up to 30 GHz frequency. Above this 30 GHz frequency the size of the resonator at high frequencies becomes so small that its Q (quality factor) deteriorates significantly. In addition, the size of the dielectric resonator becomes so small that the reliable placement of the resonator onto the microstrip circuit in mass production becomes extremely difficult.

Waveguide systems operating at millimeter wavelengths typically employ diode oscillators. These combinations are, however, clumsy and expensive.

Combinations of microstrip circuits with cavity resonators have been in use up to frequencies of several GHz, but in the millimeter wavelength range the typical coupling method based on a small probe antenna reaches its limits in terms of manufacturing possibilities.

SUMMARY OF THE INVENTION

It is an object of the present invention to overcome the drawbacks of the above described techniques and to achieve a novel type of assembly and method for coupling a microstrip circuit to a cavity resonator.

The invention is based on forming the coupling from the microstrip to the cavity resonator by means of a slot made in the ground plane and a planar radiator disposed on the surface of a coupling piece made of a suitable dielectric material.

More specifically, the assembly according to the invention comprises a substrate plate, a microstrip circuit fabricated on one side of said substrate plate, a ground plane fabricated on the other side of said substrate plate, and a cavity resonator wherein the microstrip circuit is coupled to said cavity resonator by means of a slot fabricated in said ground plane and a planar radiator disposed between said ground plane and said cavity resonator.

Furthermore, the method according to the invention comprises the steps of fabricating a microstrip circuit on one side of a substrate plate, fabricating a ground plane on the other side of said substrate plate, fabricating a slot in said ground plane, coupling said microstrip circuit to a cavity resonator by means of said slot, and disposing a planar radiator between said ground plane and said cavity resonator.

The invention provides outstanding benefits.

The resonator according to the invention can be readily manufactured for frequencies in the range 1–100 GHz. The upper ground plane can be omitted from the design, because the planar radiator directs the radiating field toward the cavity resonator. Selection and/or attenuation of different resonant modes is easy to attain by altering the position and dimensions of the planar radiator with respect to the cavity resonator. Further, temperature compensation of the operating frequency can be readily implemented by suitable material choice of the planar radiator substrate with a compensating temperature coefficient of the dielectric constant $\epsilon_p$.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION FOR THE PREFERRED EMBODIMENTS OF THE PRESENT INVENTION

Figure 1:
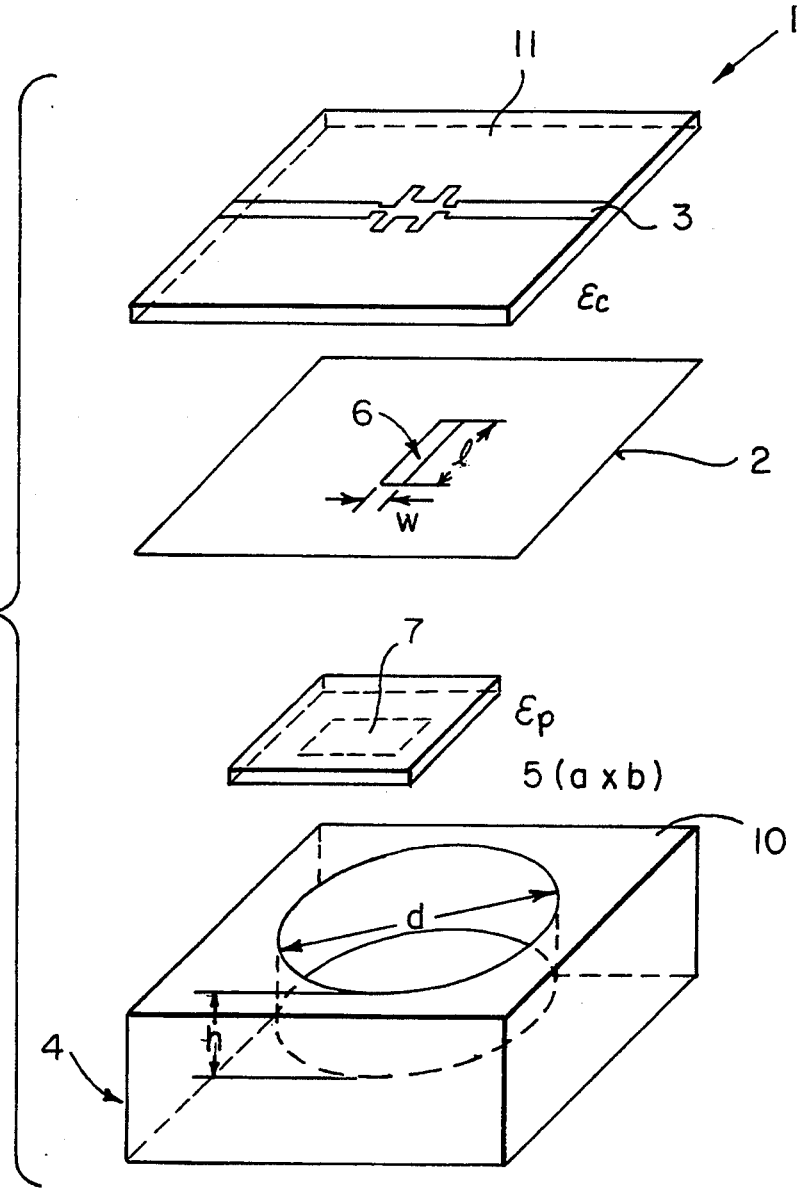
FIG. 1 shows an expanded view in perspective of the coupling circuit according to an embodiment of the invention between a microstrip circuit and a cavity resonator.
Figure 2A:
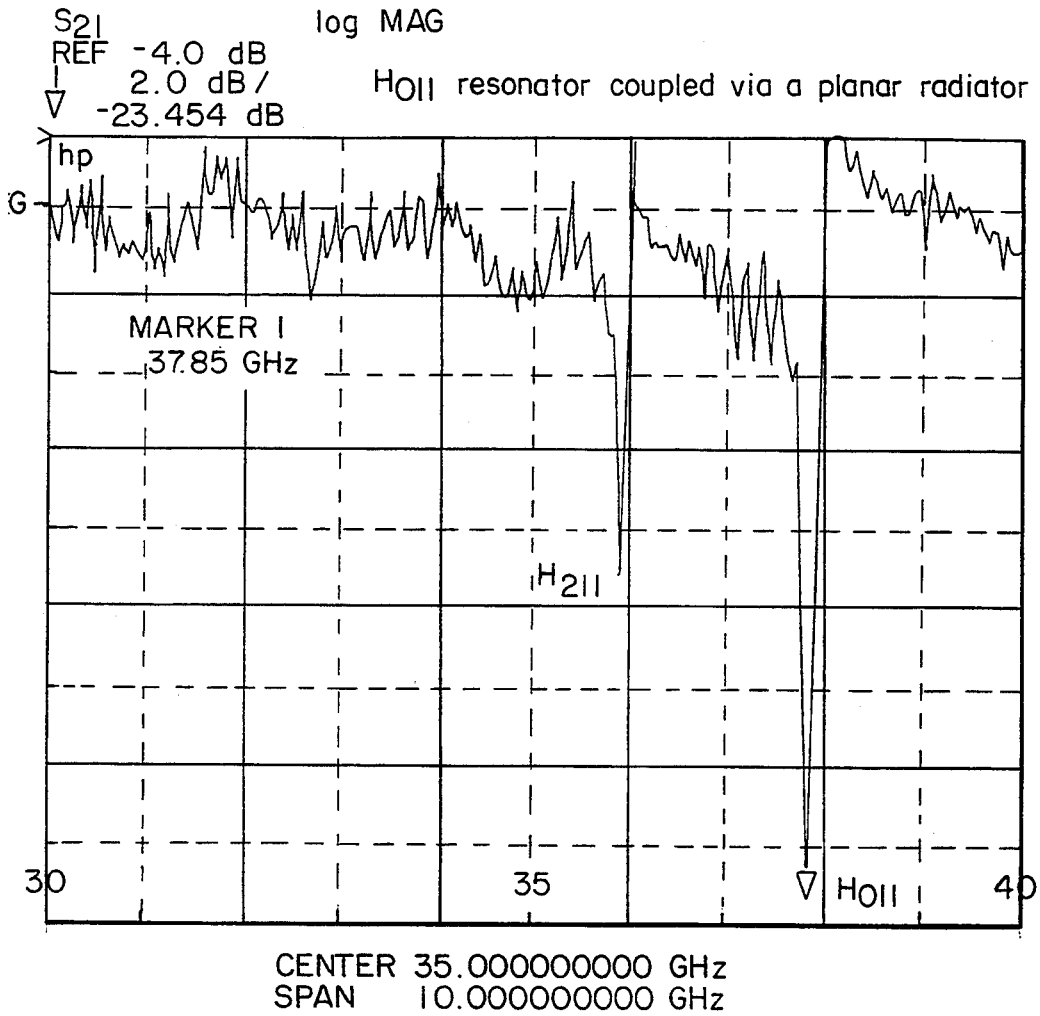
FIG. 2*a* shows a first alternative coupling coefficient of the circuit according to an embodiment of the invention in a microstrip line.
Figure 2B:
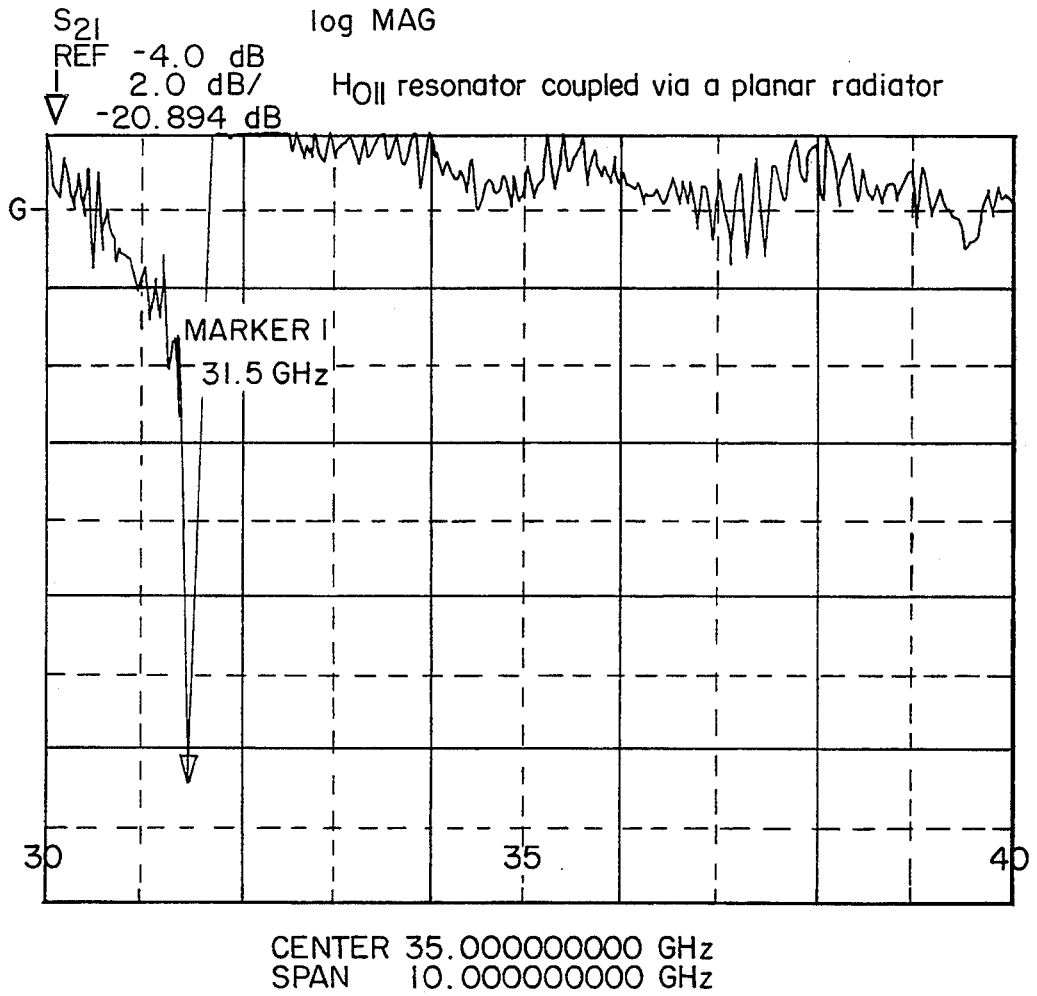
FIG. 2*b* shows another alternative coupling coefficient of the circuit according to an embodiment of the invention in a microstrip line.

For the sake of clarity, the components, for assembling a microstrip circuit to a cavity resonator in reality are closely connected, are in FIG. 1 drawn detached from each other. In practice substrate plate 1 and ground plane 2 are bonded together into a single element using, e.g., an adhesive. Onto the upper surface of the substrate plate 1 is formed a matching circuit 11 of a microstrip circuit 3 for matching the microstrip circuit 3 to a cavity resonator 4. The microstrip circuit 3 is fabricated onto the substrate plate 1 using, e.g., thin-film techniques. The thickness of the microstrip circuit 3 is advantageously used in the range of 10 . . . 15 μm and the strip width is typically 0.2 mm. The cavity resonator 4 itself is located below the ground plane 2, while the ground plane 2 and the cavity resonator 4 are separated from each other by a dielectric plate 5 which is located at a slot 6 fabricated in the ground plane 2. In this context, the dielectric plate 5 is also called the radiator substrate. The dielectric plate 5 is fixed in its place by adhesive bonding. A conductive planar radiator 7 is located to the side of the dielectric plate 5 which faces the cavity resonator 4. Thus, the dielectric plate 5 performs galvanic isolation of the planar radiator 7 from the ground plane 2. The conductive planar radiator 7 itself has a square form, whose side length conventionally is one half of a wavelength at the operating frequency. Therefore, the wavelength-related dimensions are determined by the operating frequency of the cavity resonator 4. The vertical position of the conductive planar radiator 7, orthogonally to the substrate plate 1, is not particularly critical. In the exemplifying embodiment, the conductive planar radiator 7 is spaced by the thickness of the dielectric plate 5 from the ground plane 2 so as to bring the dielectric plate 5 flush with the upper surface 10 of the cavity resonator 4. In regards to its function, the conductive planar radiator 7 acts as a Yagi antenna which directs the energy from the microstrip circuit 3 toward the cavity resonator 4. The suitable exemplifying dimensions for a 39 GHz resonator could be such as given below:

| | |
|---|---|
| Thickness of substrate plate 1 | 0.254 mm |
| Material of substrate plate 1 | Aluminium oxide ($Al_2O_3$) |
| Dielectric constant $\epsilon_r$ of substrate plate 1 | 9.9 |
| Thickness of substrate plate 1 | 0.254 mm |
| Cavity diameter (d) of cavity resonator 4 | 6 mm |
| Cavity height (h) of cavity resonator 4 | 3 mm |
| Material of cavity resonator 4 | Conductive, e.g. a metal such as gold or nickel alloy |
| Length l of slot 6, approx. half wavelength | 2.0 mm |
| Width w of slot 6 | 0.3 mm |
| Material of radiator substrate 5 | PTFE |
| Dielectric const. $\epsilon_r$ of radiator substrate 5 | 2.2 |
| Thickness of radiator substrate 5 | 0.5 mm |
| Dimensions of planar radiator 7, $a = b = \lambda/2$ | 2.5 mm |
| Material of planar radiator 7 | Gold or copper |
| Thickness of planar radiator 7 | 10 . . . 15 μm |

The assembly illustrated in FIG. 1 was measured with the results shown in FIG. *2a* after the position of the cavity resonator 4 is offset with respect to the other elements. The offset is made in the upper plane 10 of the cavity resonator 4. The coordinate system employed can be freely chosen; thus, the cavity resonator 4 is offset in the x-direction by 5 mm in reference to the other elements, while no offset in the y-direction was made. The frequencies of the resonance peaks were at approximately 35.8 GHz and 37.8 GHz.

The same assembly illustrated in FIG. 1 was measured with the results shown in FIG. *2b* when the position of the cavity resonator 4 was offset from its initial position by 1.2 mm in the y-direction, while no offset in the x-direction was made. The frequency of the resonance peak was at approximately 31.5 GHz.

Figure 3:
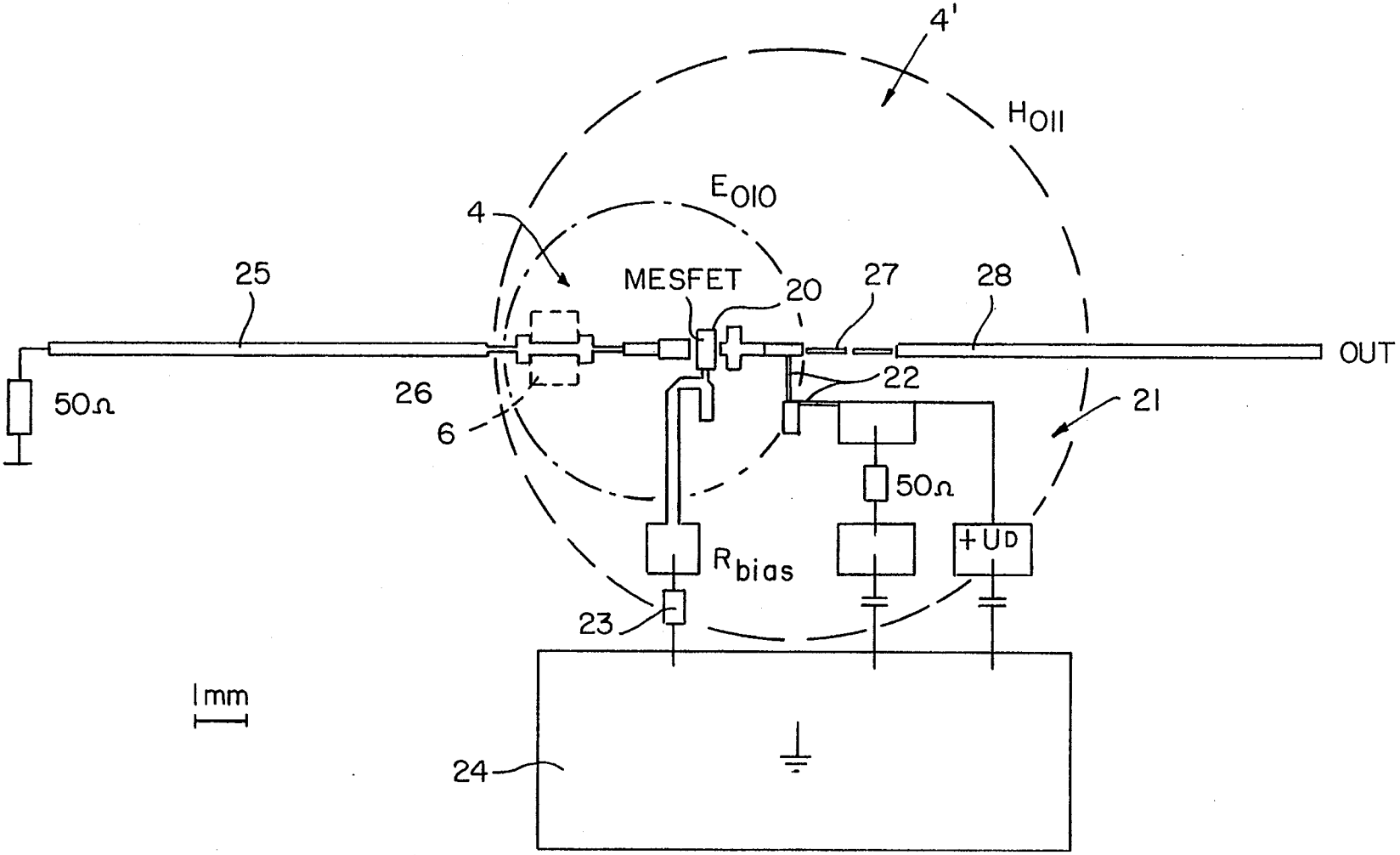
FIG. 3 shows in a top view the entire coupling configuration according to an embodiment of the invention.

FIG. 3 illustrates a practical microstrip circuit for 39 GHz frequency. The diagram is drawn to scale, and a 1 mm reference line is placed to the lower left corner of the diagram. According to FIG. 3, a MESFET device 20 is configured in the microstrip circuit so that its drain is connected to a DC supply 21 via leads 22 and bonding (not shown). Its source is correspondingly connected via a biasing resistor 23 to ground. The ground potential is provided by a plate 24, which further is connected to the ground plane behind the substrate 1. To the left of the MESFET 20 is its gate which is further bonded to a microstrip 25. The other end of the microstrip 25 is connected to ground via a 50 ohm resistor. At the cavity resonator 4, the microstrip 25 has a matching circuit 26 that matches the microstrip 25 to the cavity resonator 4. Under the matching circuit 26, a slot 6 is fabricated to the ground plane that further is covered underneath by a planar radiator (not shown). The drain of the MESFET is connected to an output strip line 28 by way of a thin-film capacitor 27. The function of the thin-film capacitor 27 is to block the DC component. A larger-diameter resonator 4' illustrates an alternative resonator design.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An assembly for coupling a microstrip circuit to a cavity resonator, said assembly comprising:

a substrate plate;

a microstrip circuit disposed on one side of said substrate plate;

a ground plane disposed on the other side of said substrate plate; and a cavity resonator coupled to the microstrip circuit by means of a slot disposed in said ground plane and a planar radiator disposed between said ground plane and said cavity resonator.

2. An assembly as defined in claim 1, wherein said planar radiator comprises a planar and square shape, in which the square shape is dimensioned as $\lambda/2 \times \lambda/2$, where $\lambda$ is the wavelength at the operating frequency of said cavity resonator.

3. An assembly as defined in claim 1, wherein said planar radiator is disposed onto a radiator substrate comprising polytetrafluorethene (PTFE).

4. A method for coupling a microstrip circuit to a cavity resonator comprising the steps of:

a) fabricating the microstrip circuit on one side of a substrate plate;

b) fabricating a ground plane on the other side of said substrate plate;

c) fabricating a slot in said ground plane;

(d) coupling the microstrip circuit to the cavity resonator by means of said slot fabricated in said ground plane at said step (c); and e) disposing a planar radiator between said ground plane and the cavity resonator.

5. A method as defined in claim 4, wherein said planar radiator is formed of a planar and square shape in which the square shape is dimensioned as $\lambda/2 \times \lambda/2$ where $\lambda$ is the wavelength at the operating frequency of said cavity resonator.

6. A method as defined in claim 4, wherein said planar radiator is fabricated onto a radiator substrate comprising polytetraflurethene (PTFE).

* * * * *